US008418774B2

(12) United States Patent
Gensel et al.

(10) Patent No.: US 8,418,774 B2
(45) Date of Patent: Apr. 16, 2013

(54) FIRE EXTINGUISHING SYSTEM FOR A CASING

(75) Inventors: Joachim Gensel, Luebeck (DE); Wolfgang Habitzl, Neumittendorf (AT); André Lickefett, Herrnburg (DE)

(73) Assignee: Minimax GmbH & Co. KG, Oldesloe (DE)

( * ) Notice: Subject to any disclaimer, the term of this patent is extended or adjusted under 35 U.S.C. 154(b) by 399 days.

(21) Appl. No.: 12/383,970

(22) Filed: Mar. 31, 2009

(65) Prior Publication Data

US 2009/0188682 A1 Jul. 30, 2009

Related U.S. Application Data

(63) Continuation of application No. PCT/DE2007/001793, filed on Oct. 9, 2007.

(30) Foreign Application Priority Data

Oct. 9, 2006 (DE) ..... 10 2006 048 015

(51) Int. Cl.
*A62C 8/00* (2006.01)
*A62C 25/00* (2006.01)
*A62C 27/00* (2006.01)
*A62C 29/00* (2006.01)

(52) U.S. Cl.
USPC ..... 169/51; 169/56; 169/60; 169/61; 340/289

(58) Field of Classification Search ..... 169/54, 169/56, 57, 60, 61, 46, 51; 340/286.05, 289
See application file for complete search history.

(56) References Cited

U.S. PATENT DOCUMENTS 2,287,873 A * 6/1942 Geertz et al. ..... 169/71
4,819,732 A * 4/1989 Laumeister ..... 169/61
5,123,490 A * 6/1992 Jenne ..... 169/61
5,573,066 A * 11/1996 Vaillancourt et al. ..... 169/49
(Continued)

FOREIGN PATENT DOCUMENTS

DE 89 13 487 4/1990
DE 91 16 325 10/1992
(Continued)

OTHER PUBLICATIONS

International Search Report of PCT/DE2007/001793.

*Primary Examiner* — Len Tran
*Assistant Examiner* — Justin Jonaitis
(74) *Attorney, Agent, or Firm* — Collard & Roe, P.C.

(57) ABSTRACT

A fire extinguishing system for a casing, preferably an electronics casing, consisting of an extinguishing agent container, in which the extinguishing agent is stored, and a control device for the flow of extinguishing agent is provided, wherein a preferably cuboid extinguishing agent container (2) forms together with the devices (5, 7, 8, 29, 31, 32) required for storing and monitoring the loss of extinguishing agent, for controlling the flow of extinguishing agent from the container and for connecting a discharge device for the extinguishing agent, a complex structural component (24, 28), and wherein the devices (5, 7, 8, 29, 31, 32) are fastened at or integrated in the extinguishing agent container (2) in such a manner that this may be transported, installed or arranged in the casing (18) as a compact structural component (FIG. 2). The invention has the advantage that all devices required for the extinguishing of fire, like extinguishing agent container, power supply unit, evaluation electronics, are able to be inserted with low space requirement in a quick and reliable manner into a casing according to the sense of the present document.

15 Claims, 7 Drawing Sheets

U.S. PATENT DOCUMENTS

Figure 1:
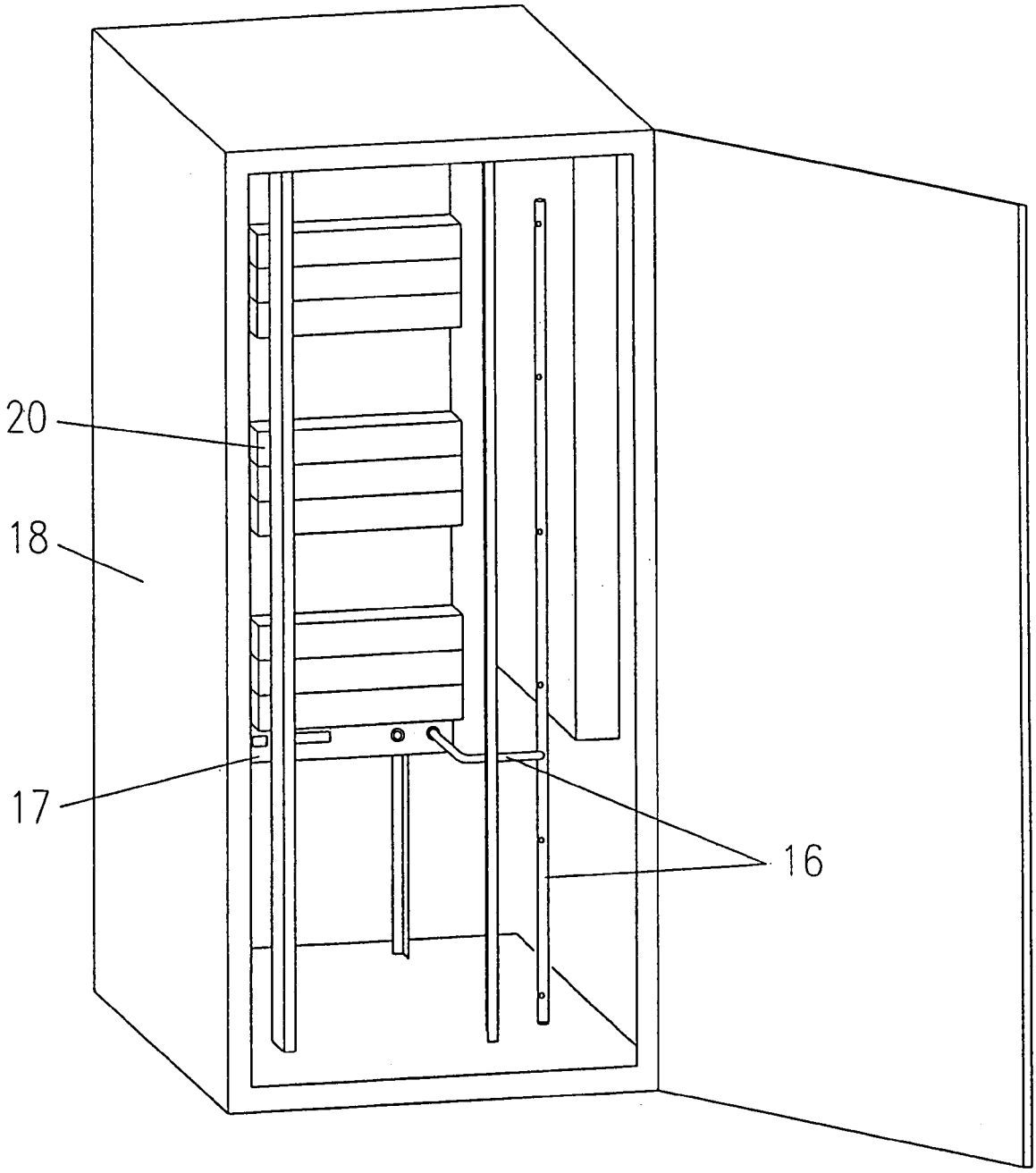

| | | | | |
|---|---|---|---|---|
| 5,887,662 | A | 3/1999 | Sundholm | |
| 6,720,886 | B2 | 4/2004 | Seelbach et al. | |
| 6,952,169 | B1 | 10/2005 | Simtion | |
| 2007/0103325 | A1 * | 5/2007 | Wagner et al. | 340/628 |

FOREIGN PATENT DOCUMENTS

| | | |
|---|---|---|
| DE | 299 01 776 | 5/1999 |
| DE | 101 14 729 | 10/2002 |
| DE | 203 17 604 | 2/2004 |
| DE | 10 2004 029 655 | 1/2006 |
| DE | 20 2004 020 773 | 1/2006 |
| EP | 0 459 944 | 12/1991 |
| WO | WO 2005/030338 | 4/2005 |

* cited by examiner

FIRE EXTINGUISHING SYSTEM FOR A CASING

CROSS REFERENCE TO RELATED APPLICATIONS

Applicants claim priority under 35 U.S.C. §119 of German Application No. 10 2006 048 015.5 filed Oct. 9, 2006. Applicants also claim priority and this application is a continuation under 35 U.S.C. §120 of International Application No. PCT/DE2007/001793 filed Oct. 9, 2007, which claims priority under 35 U.S.C. §119 of German Application No. 10 2006 048 015.5 filed Oct. 9, 2006. The international application under PCT article 21(2) was not published in English.

The present invention relates to a fire extinguishing system according to the features of the first patent claim.

The invention is suited for casings, in particular for casings for electronics, or switchgear cabinets, into which the electronic units may be plugged in or built in, for example by means of guides or guide bars, and in which a quick exchange of the functional parts, like extinguishing agent container, fan or loading cartridge, should be ensured, a compact construction for the extinguishing system should be provided, as much extinguishing agent as possible should be stored in the available space and a quick connection of the extinguishing unit should be possible. There is, however, also the possibility, to arrange the fire extinguishing system at a wall or at the door of the casing to be protected.

Also rooms in which only a limited space is available for the storage of the extinguishing agent or for the fire extinguishing system, respectively, like rooms in vehicles, ships or airplanes, and in which not enough extinguishing agent may be stored in the case of fire extinguishing systems with conventional containers, are counted among the rooms or casings which may be protected by means of the solution according to the present invention.

Casings for electronics, which are equipped with fire extinguishing systems, are well known. From DE 101 14 729 A1, a switchgear cabinet with a smoke detecting device is known, which comprises an intake pipe and, in a casing, a smoke sensor, which is arranged in the flow pass of a fan. The fan draws air from the interior of the switchgear cabinet into the casing via an inlet aperture in a casing wall and discharges it via an outlet into the space outside the casing. The sensitively responding smoke detecting device is connected with its upper end region to the intake pipe, the outlet is disposed in the interior of the switchgear cabinet. The smoke detecting device sets off the alarm. A fire extinguishing system is not provided within the switchgear cabinet.

DE 10 2004 029 655 A1 describes a fire protection device and method for electronic devices with automatic fire detection, fire alarm and fire fighting, said device being able to be slidingly inserted into the device to be protected. The protective module comprises a smoke sensor, evaluation electronics, signal diodes, signal tone generators, control electronics, breaker relays, a fan and a current supply. Furthermore a cartridge with extinguishing gas comprising a magnetic valve and an operational key is provided. An inert extinguishing gas is used as extinguishing means, which is stored in the extinguishing gas cartridge. It cannot be seen from the document how the individual aggregates are dimensioned and arranged in the plug-in cavity.

In EP 0 459 944 A1 an apparatus and method for an object-bound fire protection of electric and/or electronic systems as well as the utilization of this apparatus are described. In the casing of the system to be protected, a fire detector must be provided in the hot air current of the system to be protected and at least one outlet opening of an extinguishing agent container must be arranged within the casing of the system to be protected. All further aggregates are likewise arranged in this space, but this system does not represent a compact unit.

In DE 20 2004 020 773 U1 a switch cabinet with a ventilation unit for exhausting and drawing off a cooling air stream passing through the switch cabinet on a flow path is described, in which a device for early detection of fire is provided, which includes a detector arranged in or extending into the flow path to detect a fire characteristic. Configuration features of the switch cabinet may be seen from this document. On the cabinet there are arranged devices for early detection of fire, a complete fire extinguishing system, however, cannot be found in this document.

DE 299 01 776 U1 describes a switch cabinet in which a complete fire extinguishing system is arranged. In a frame-like rack, which represents a plug-in unit, the fire alarm center, the sensor, the extinguishing agent container and the spraying device are arranged. The plug-in unit is mounted in the upper part of the switch cabinet, so that the disadvantage arises that a particular location must be used for this plug-in unit. Furthermore, also the spraying device and the sensor must be arranged in the upper part of the cabinet, which contains in itself the danger that fires in the lower part of the switch cabinet are detected and extinguished only with a delay.

An extinguishing device for a switch cabinet is also known from DE 89 13 487.7 U1. This device is a compact unit, which is arranged in the upper part of the electronics cabinet, the nozzle tube being arranged in the wall of the switch cabinet and a sensor being arranged approximately in the center of the cabinet. The extinguishing unit may be swiveled out of the cabinet by means of a hinge. It is a disadvantage that the connections between the swiveling part and the stationary parts mounted in the cabinet must be assembled in a complicated manner, are not constructed in a complex manner and that the structural member with the fire extinguishing systems has a disadvantageous and considerably larger overall height than that of the described invention.

DE 203 17 604 U1 discloses a fire extinguishing system for personal computer tower casings, in which an autonomously working fire detection and fire extinguishing system with an integrated smoke and heat alarm, a manual release key, control electronics, a buffer battery as well as carbon dioxide containers with pyrotechnic activation for the release of extinguishing agent in the case of fire is provided, the whole system being accommodated in a 5.25 inch standard plug-in casing of a personal computer and, besides the connection to the power supply unit of the computer, no further connecting or cabling operations being required. In the casing, there are arranged several $CO_2$ cartridges at the ends of which the pyrotechnic activation is arranged and adjacent thereto the control electronics, smoke and fire alarm, respectively, being arranged. Furthermore, manual release keys and indication means for the function of the activation are provided. Due to the presence of several round cartridges, only a very limited stock of extinguishing agent is available. At the extinguishing agent containers there are also no accommodations for means required for monitoring losses and level indicators.

It is likewise not obvious from U.S. Pat. No. 5,887,662 A to design extinguishing agent containers with a flat configuration so that they may be arranged in a space-saving manner in a fire extinguishing system for a casing. Indeed, this document discloses a manometer arranged at a gas bottle, this document, however, does not disclose that gas bottle and manometer are provided for a fire extinguishing system for a casing.

In DE 91 16 325 U1 an apparatus for fire fighting in electrical devices is provided, also the utilization for switch cabinets being mentioned and several extinguishing agents being specified, which are suitable for utilization for fire fighting in electronic devices. Furthermore, batteries for the operation are mentioned. It is, however, not made obvious by this document, to use the apparatus together with a very compact extinguishing agent container at which all necessary aggregates are arranged.

DE 299 01 776 U1 describes a switch cabinet with a plug-in unit on which an extinguishing agent container having a valve is arranged, and in which the extinguishing agent container is connected to a spraying apparatus, the fire alarm center, the sensor, the extinguishing agent container and the spraying device being arranged in the upper part of the frame of a plug-in unit. However, the solution does not describe a compact extinguishing agent container but a conventional bottle, which is not designed in a flat configuration and on which no accommodations for arranging means for monitoring losses, level indicators or the like are provided. Thus, larger free spaces are present in the plug-in part of the fire extinguishing system.

Casings for electronics with fire extinguishing systems according to the known state of the art normally have the disadvantage that either not all parts required for extinguishing fire are present in the switch cabinet or, as far as these parts are present, these parts are not arranged in a complex and quickly exchangeable manner so that also extinguishing nozzles and tapping means for tapping the extinguishing gas flow are provided at the required locations. As far as these are arranged within the switch cabinet, they are not arranged in a space-saving manner and cannot be connected with low effort in a quick, reliable and simple manner to further parts.

It is the object of the invention, to provide a fire extinguishing system for casings, preferably for electronics casings, in which all parts required for the extinguishing operation, like extinguishing agent containers, power supply unit, evaluation unit, can be inserted into the casing with low space requirement and in a quick manner.

This object is attained by a fire extinguishing system according to the features of the first claim.

Further advantageous embodiments of the invention are shown in the dependent claims.

The solution according to the invention provides a fire extinguishing system for being mounted in or at e.g. the side wall, door or top wall of a casing, for example a switch cabinet, a casing for electronics or the like, in which the extinguishing agent container has a shape deviating from the known cylindrical shape, preferably a cuboid shape, and in which the extinguishing agent container contains all electronic and/or mechanical means for a loss detection of extinguishing agent, for closing the container and for controlling the flow of extinguishing agent from the container, so that a compact unit is formed. The extinguishing agent container forms a unit in which and/or at which all "fire extinguishing components" are included: These are the extinguishing agent container itself, an apparatus for measuring and/or indicating the filling level (loss detection), a closing device for the container, an apparatus for controlling the extinguishing agent flow from the container and a connecting element for delivering the extinguishing agent. Its maximum height may amount to 44.5 mm (1 height unit HE=1¾" or 44.5 mm). The extinguishing agent container may be pressure-proof and in this case consist e.g. of aluminium or it may be pressureless and in this case e.g. plastics material will be suited. In its design, all mentioned elements are integrated. It is, however, likewise advantageous to arrange the mentioned elements at the outside of the container.

Basically, the following structural types are preferred:

- The extinguishing agent container is a compact unit, which contains all "fire extinguishing components" and is shaped as a built-in or plug-in unit.
- The fire extinguishing system is a compact unit with all "fire extinguishing components" and comprises further parts, e.g. the fire alarm system.
- The extinguishing agent container is not a composite part of a built-in or plug-in unit, but is constructed as a compact unit with all "fire extinguishing components", which is e.g. mounted at a wall or a door of the casing.
- The extinguishing agent container is a compact unit with all "fire extinguishing components", further elements of the fire extinguishing system, e.g. parts of the fire alarm system, being integrated into the interior space of the extinguishing agent container.

A filling level sensor, a monitoring and evaluation unit or a filling level indicator are suited as filling level indicating device. A mechanical pressure transducer, a manometer, a gauge-glass or an electric monitoring device with a sensor may be provided as monitoring device for the filling level. The closing device of the container makes sure that the extinguishing agent remains in the container during transportation and under standby conditions. The closing device of the container may be a mechanical element, e.g. a bursting disk, a ball valve, or an electrical element, e.g. a magnetic valve. The control of the flow of extinguishing agent from the container may be effected mechanically, pyrotechnically, electromagnetically, preferably by puncturing a membrane, which seals the extinguishing agent container, by opening a pressure gas cartridge or by means of an electromechanical actuator. After opening the closing device of the container, the extinguishing agent leaves the container and is supplied to an extinguishing agent delivering apparatus. For this purpose, a nozzle may be screwed directly into the extinguishing agent container. Alternatively, the nozzle may be connected by means of other known connecting elements, e.g. by means of a length of pipe, to the container connection. In the case of compact units designed as built-in or plug-in units, the nozzle may preferably be mounted in the front face or in the back face of the extinguishing agent container in order to target the extinguishing agent to those sections of the electronics casing, which have only a few spray obstructions and thus promote a uniform and quick distribution of the extinguishing agent.

The nozzle may also preferably target the extinguishing agent to those sections from which it is transported, e.g. by means of a ventilation system, to all and/or remote sections of the electronics casing. Nozzles may also be formed in that one or several openings are incorporated directly in the extinguishing agent container. The spreading by means of an extinguishing agent valve is also feasible. A bursting disk, a safety valve or another break-off piece are suited as overpressure protection. Also the wall of the container may be weakened selectively at certain locations in order to fulfill this function and to avoid further structural parts.

The extinguishing agent container comprises a connection for the filling with extinguishing agent, the pressurizing or the drawing off of the extinguishing agent. It is conceivable to pressurize the extinguishing agent container by means of a cartridge by means of propellant gas, e.g. $N_2$. The pressurization may be effected by permanent pressure, but also only not before the extinguishing agent container is opened. Furthermore, the pressure gas may also be provided in the extinguishing agent container itself above an extinguishing liquid, e.g.

water, or also in the extinguishing gas itself, which is stored in this container under pressure. The closing device of the container and the device for controlling the flow of extinguishing agent out of the container may be separate structural parts. When storing water, for example, a bursting disk or a bursting film may form the closing of the container. In this case, the device for controlling the flow of extinguishing agent out of the container may be formed by a pyrotechnic releasing element, by means of which a pressure gas cartridge is opened. The subsequent pressure build-up in the container causes an opening of the closing device of the container. The closing device of the container and the device for controlling the flow of extinguishing agent out of the container may also be combined in a structural unit. When storing an extinguishing gas, for example, under inherent pressure, a magnetic valve may form the closing device of the container and at the same time the device for controlling the flow of extinguishing agent. Furthermore, it is conceivable to convey the extinguishing agent out of the container by mechanical means, e.g. by a drawing off and displacing process. In this case, the displacing device may at the same time be the device for controlling the flow of extinguishing agent. In the non-operative condition, the displacing device stands still. The flow of extinguishing agent out of the container is directly controlled by activating or deactivating the displacing device.

In addition, it is conceivable to produce a gas volume by means of a gas generator as a result of a chemical or pyrotechnical reaction.

A further possibility is the pressurization by means of nitrogen, helium or in the form of a permanent pressurization.

In the case of compact units designed as plug-in units, the compact unit is pushed as far as possible into a compartment of the electronics container or casing. The manner how to design the adapter unit so that intake pipe, nozzle tube and, if applicable, electronic connections are connected in a functionally reliable manner, is known to one skilled in the art. One skilled in the art does further know, how the guide rails must be designed so that the compact unit is reliably guided and mounted.

Preferably, the compact unit is designed as a complete fire extinguishing system and in a flat configuration with a height of only 1 HE, which is able to detect and extinguish fires in casings. Chemical liquids like FK-5-1-12, HFC 227ea, HFC 125, HFC 23 are preferably used as extinguishing agent, which vaporize for the most part at an opening, for example a nozzle or a nozzle tube, and are primarily in gaseous form effective for extinguishing. The fire detection is made by means of sensors adapted to the fire parameters, which are technically denoted as automatic fire alarms. As sensors e.g. optical smoke detectors, smoke detectors according to the ionization principle, CO-detectors, temperature indicators, gas detectors or conflagration gas detectors may be used. The secondary products of a fire (for example smoke) are supplied to the sensors preferably via openings in the casing of the fire extinguishing system, and further preferably by means of a fan, which draws air from the switch cabinet, supplies the air to the sensors and subsequently conveys the air from the casing of the fire extinguishing system back to the switch cabinet. In order to draw air simultaneously from different locations of one or more switch cabinets, the fan may be connected to a pipe system with several intake openings. Alarms and disorders are transferred by means of potential-free contacts or via a data bus to higher-order monitoring or guiding devices. Due to the compact construction and the small overall height of 1 HE, this unit may be integrated in switch cabinets in an easy and space-saving manner.

Furthermore, it is advantageous to arrange an operating and display panel at one side, preferably at the front side, of the fire extinguishing system, which advises the personnel of the active state of the fire extinguishing system. Also a release key as well as connections for external acoustic or optical alarm devices, activators or deactivators for the extinguishing operation may be included.

For certain kinds of use it is advantageous when the extinguishing agent container contains an extinguishing gas like $CO_2$, argon or nitrogen as extinguishing agent. The pressurization of the extinguishing agent container may be effected in an advantageous manner by means of argon, nitrogen, helium or $CO_2$ by means of a one-way cartridge, which is punctured mechanically or broken pyrotechnically. It is, however, also conceivable to use a refillable reusable cartridge.

Water or water with additives, e.g. foaming agents, or special aqueous extinguishing agents for extinguishing fires caused by oil or fat may also be used as extinguishing agent. Furthermore, it is conceivable to fill the extinguishing agent container with an extinguishing powder, which will be discharged.

At the extinguishing agent container, a fire alarm center, an electronic control device or an evaluation device, which evaluates the data of the sensor and activates the release device at the extinguishing agent container in the case of fire, may be arranged.

Also a power supply unit or a battery unit may be arranged at the extinguishing agent container. Furthermore, also an emergency power unit is conceivable. At one side of the extinguishing agent container, preferably at the front side, an operating and display panel may be arranged.

The extinguishing agent container may be mounted together with further components to form a "mechanical structural component". The extinguishing agent container may be arranged within a casing of the fire extinguishing system or of the plug-in unit, respectively, or form a part of the casing or of the plug-in unit, respectively. In the latter case, the extinguishing agent container may also fulfill further functions, e.g. as a guide during insertion, as stop point or mounting point.

The extinguishing agent container is preferably designed in such a manner that it has a small overall height and for this reason, no cylindrical or other standard container is used but a flat, approximately cuboid container. If the space, which is available for the fire extinguishing system or the stock of extinguishing agent is different due to geometrical circumstances, e.g. trapezoid or tapered along its length, the shape of the container may also be adapted to the available geometry for an optimum utilization of this space and for maximizing the amount of extinguishing agent that may be stored, or for a compact storing in such a manner that the remaining space may be used for other purposes or other constructional elements. In order to ensure the desired resistance to pressure of the container in spite of the shape that is unfavorable for pressure loaded parts, the container is provided in its interior preferably with elements absorbing the tensile forces and thus avoiding a too strong bending of the walls. In the case of containers made of cast/molded materials, these elements are preferably likewise cast/molded. In particular in the case of small-lot production, the extinguishing agent container may be made of several parts, and in this case, the tensile forces absorbing elements may be screw connections, for example. Preferably, the extinguishing agent container is either milled from a metal plate, into which cavities are milled for receiving the extinguishing agent, a further metal plate being used as a lid, or made from a rectangular hollow section with welded or screwed on lids and junctions.

As an alternative, the flat container may be formed by arranging several individual containers, preferably made of rectangular hollow sections.

As an alternative, the flat container may also be made of high-duty materials in order to minimize the necessity of providing elements absorbing the tensile forces. The fire detecting units may be arranged separately from the structural component of the extinguishing agent container, but also within the casing of the fire extinguishing system. By the formation of structural components "extinguishing agent container" (e.g. container together with nozzle or nozzle tube, filling level indicator, pressure generator, overpressure protection, release device) and "fire alarm system with extinguishing system control", it is possible to activate with one fire alarm system with an extinguishing system control several extinguishing agent container units, for example, when the content of one extinguishing agent container is too small. In this case, it is advisable to use only one unit containing the structural component "fire alarm system with extinguishing system control", and several units, e.g. plug-in units, with the structural component "extinguishing agent container", which, however, may be controlled individually or commonly by the common fire alarm system with an extinguishing system control. In this case, it will be advantageous to arrange a nozzle tube, an intake pipe, a sensor, sensor electronics, a fan, a power supply unit, evaluation electronics and an emergency power unit outside of the "fire extinguishing components", which are directly mounted at the extinguishing agent container. As regards the sensors, it will be advantageous to provide optical smoke detectors, ionization smoke detectors, gas detectors, CO-detectors, conflagration gas detectors, intake sensors or temperature indicators.

It will be of advantage, if the corresponding connections for an adaptor provided at the switch cabinet, having, for example the configuration of an adaptor rail, are arranged at the built-in or plug-in unit or directly at the "fire extinguishing components". For this purpose, connections are provided at the backside or near the backside of the upper or lower side of the casing of the fire extinguishing system, for example, and corresponding connections are provided at the switch cabinet. These corresponding connections may be designed as individual connections, e.g. one for the voltage supply, one for the alarm transmission, one for the connection of the fan arranged in the casing of the fire extinguishing system with an intake pipe outside of the casing of the fire extinguishing system. It is, however, also possible to combine the corresponding connections to a structural unit, so that only one collective connection has to be connected to the fire extinguishing system. Preferably, the corresponding connections are arranged on an adaptor rail in such a manner that the engagement of all connections with their corresponding connections is effected automatically when slidingly inserting the casing of the fire extinguishing system. It is, however, also conceivable to make only certain connections automatically, e.g. the electric lines, during the insertion and to make the connections to other elements arranged outside of the casing of the fire extinguishing system not automatically during the insertion. Thus, connections for an intake pipe system or a nozzle tube system may be arranged e.g. at the backside of the casing of the fire extinguishing system, said pipe systems being only installed or connected to the casing of the fire extinguishing system after the casing of the fire extinguishing system has been inserted. For this purpose, connections with known techniques may be used, for example with threaded connectors, clamping or plug-type connectors, couplings, pipe connectors.

The nozzle tube may be in communication with a nozzle tube system fixedly connected to the switch cabinet either by means of the adaptor rail or may simply be pushed through the adaptor rail.

In an advantageous manner, the maximum height of the built-in or plug-in unit is below 44.5 mm.

Figure 2:
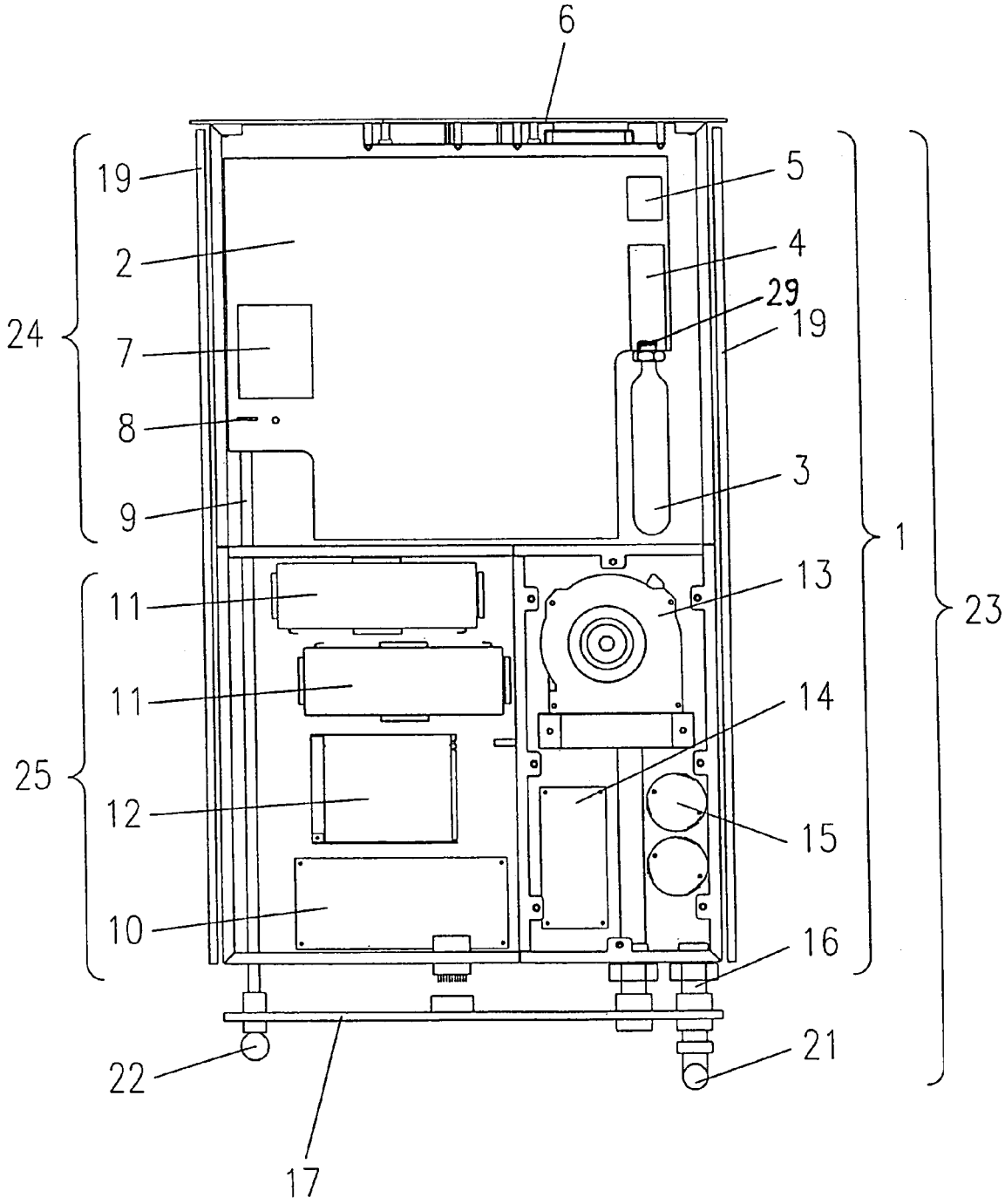
Figure 3:
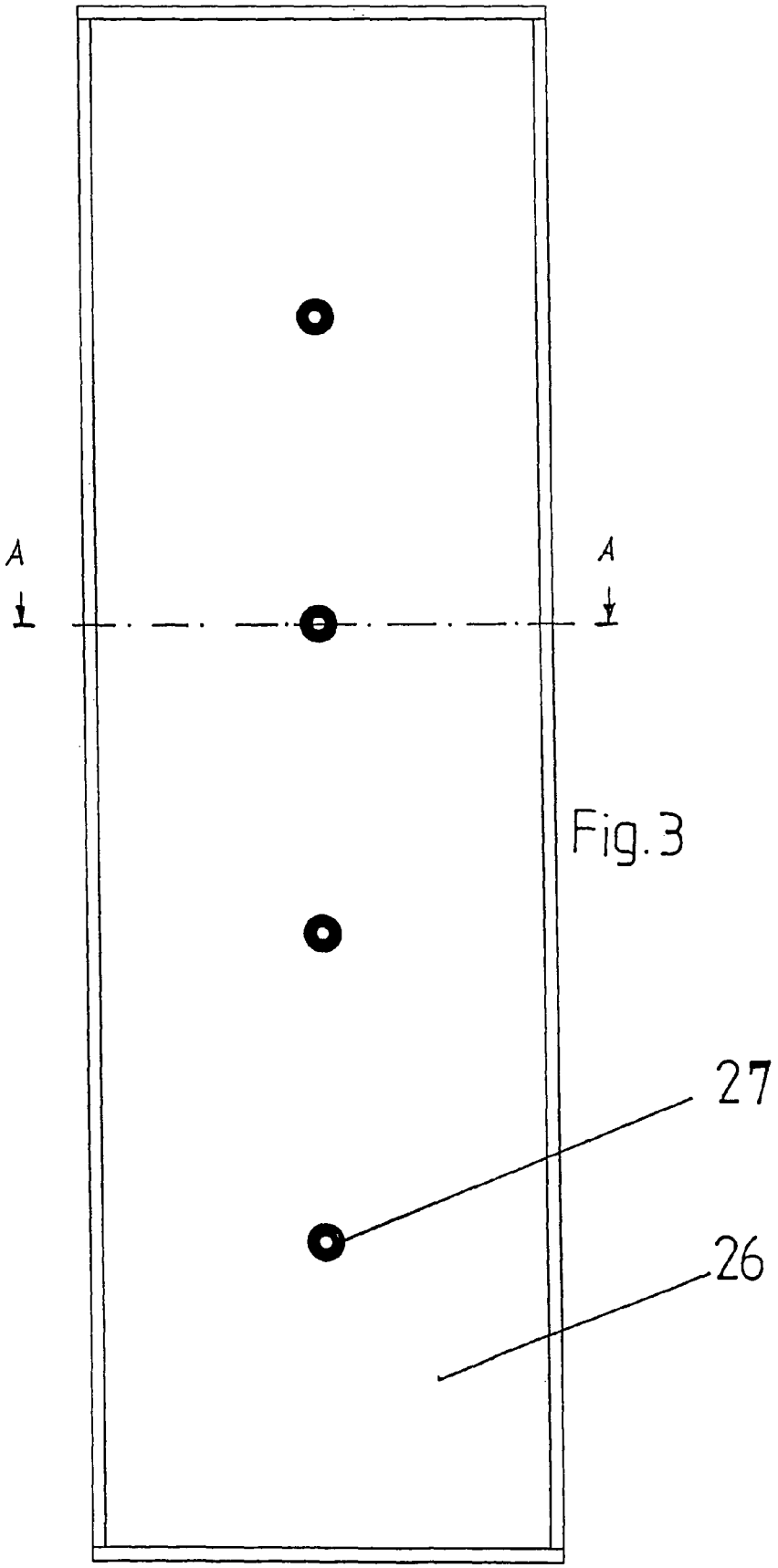
Figure 4:
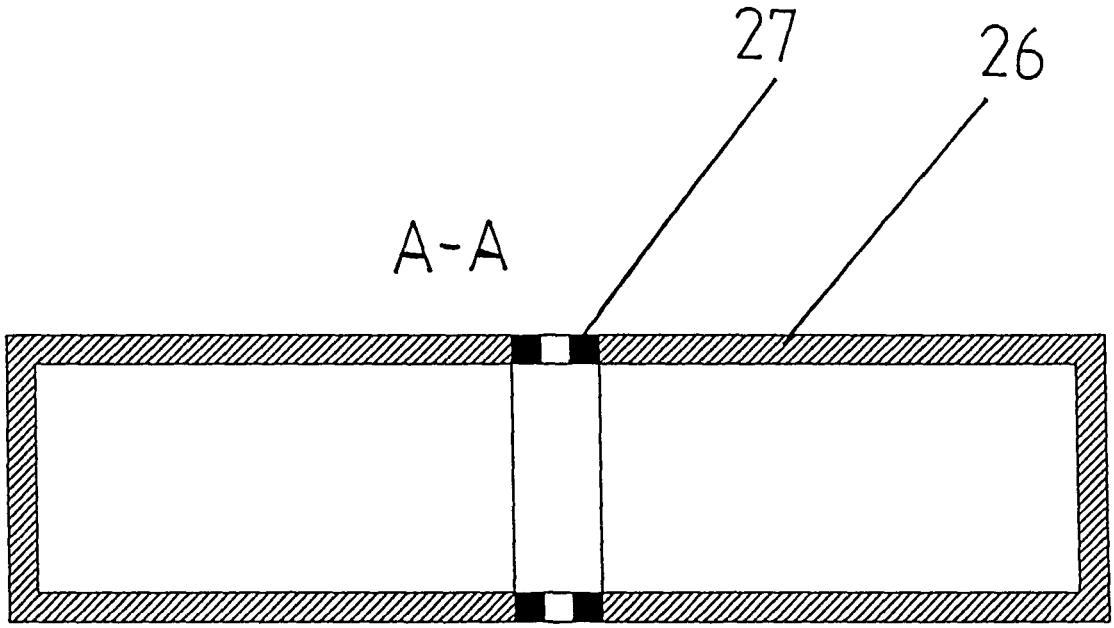
Figure 5:
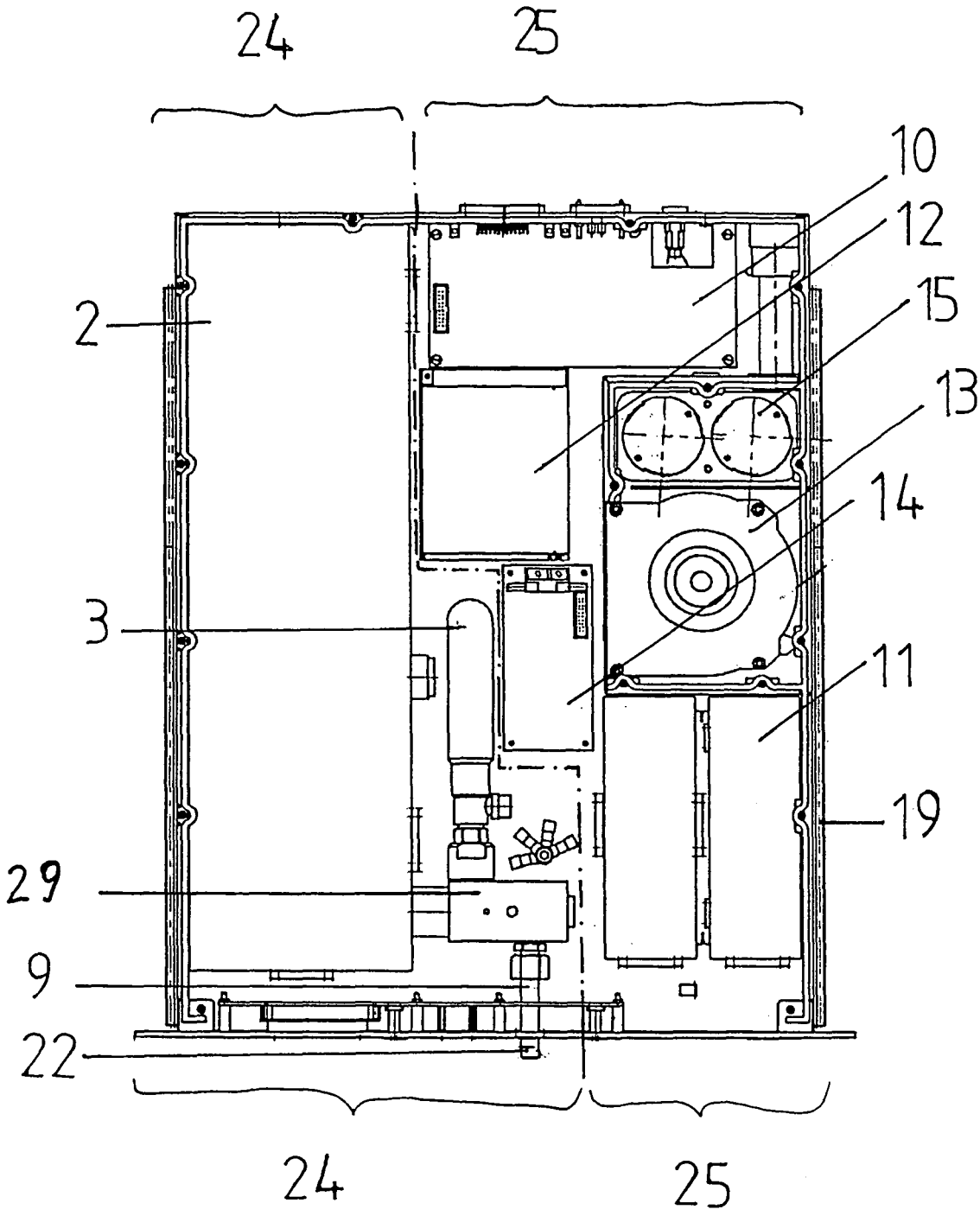
Figure 6:
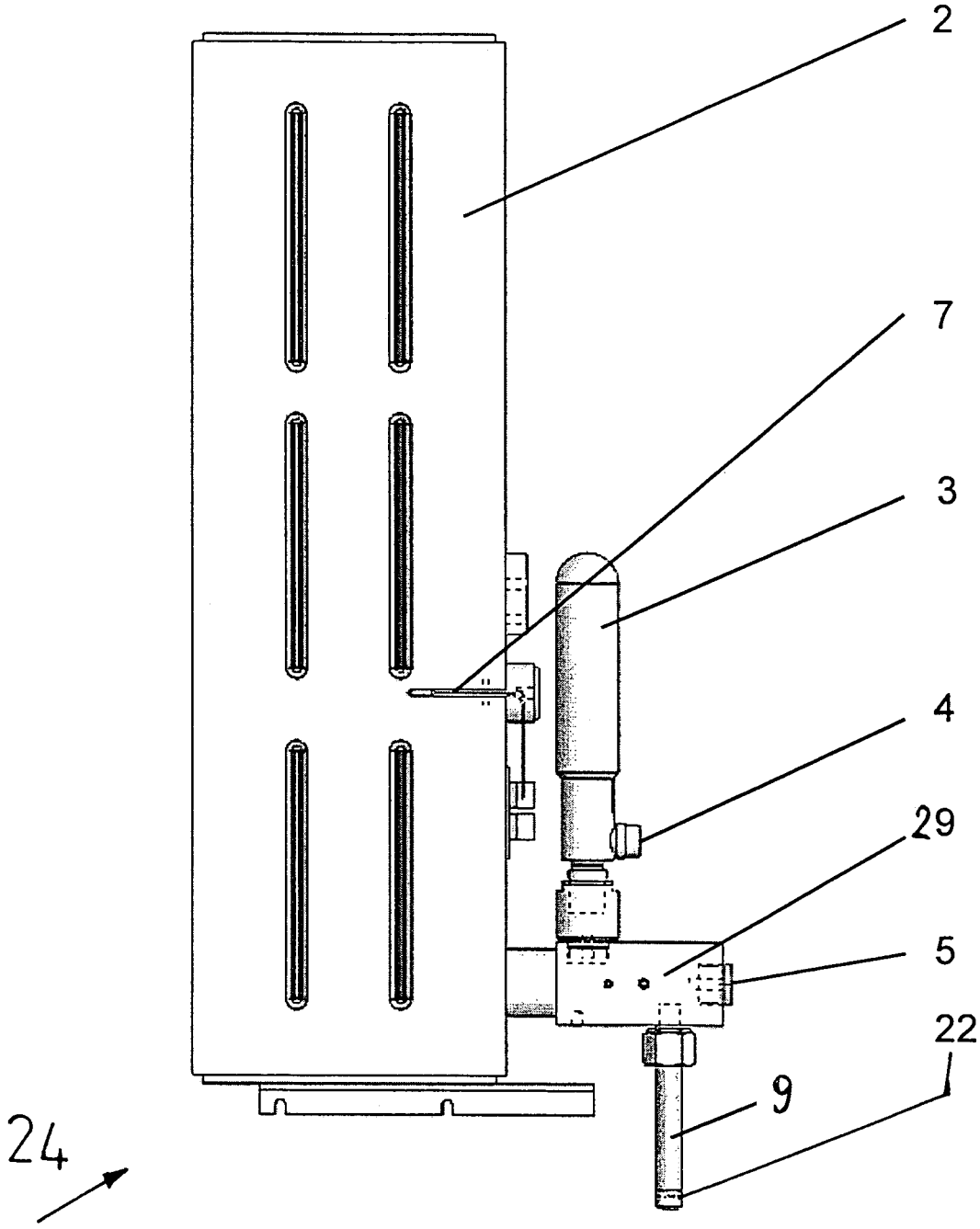
Figure 8:
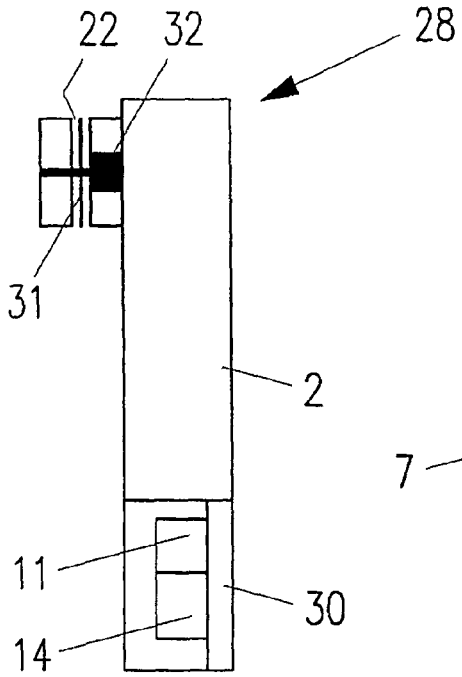
Figure 7:
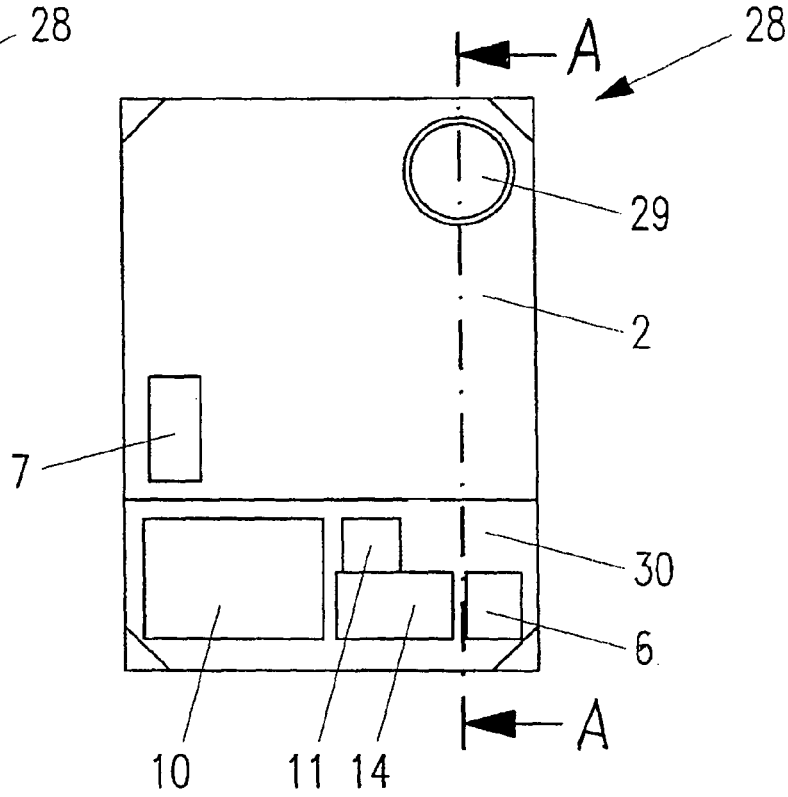

In the following text, the invention is described in detail by means of an embodiment and drawing figures. The figures show:

FIG. 1: a perspective view of a switch cabinet with a fire extinguishing system provided therefor, FIG. 2: a top view of a compact unit with extinguishing agent container in a flat configuration and designed as complete fire extinguishing system, which is slidingly insertable into the switch cabinet, FIG. 3: a top view of the extinguishing agent container in a flat configuration, FIG. 4: a sectional view on the line A-A in FIG. 3, FIG. 5: a top view of a compact unit with extinguishing agent container in a flat configuration and designed as complete fire extinguishing system, which is slidingly insertable into the switch cabinet, FIG. 6: the structural component consisting of the extinguishing agent container of FIG. 5 with the fire extinguishing components and devices for spreading the extinguishing agent, FIG. 7 a fire extinguishing system in flat configuration for being mounted at an interior wall or a door in a switch cabinet, FIG. 8 a sectional view on the line A-A in FIG. 7.

FIG. 1 shows a switch cabinet 18, in which compartments 20 are arranged into which electrical or mechanical units may be slidingly inserted. An intake pipe 16 is arranged in the switch cabinet 18. The intake pipe 16 comprises openings at those locations at which it is advantageous to take samples of air from the switch cabinet 18 for a fast detection of fire.

The fire extinguishing system, as it is shown in FIG. 2, is slidingly insertable into one of the compartments 20 of the switch cabinet 18 as built-in or plug-in unit.

FIG. 2 shows the fire extinguishing system 23 for the switch cabinet 18 consisting of the structural component extinguishing agent container 24, the structural component fire alarm system with electric control device 25 and the adaptor rail 17, which is integrated into the switch cabinet 18, with an opening for the nozzle tube 22 and the intake pipe 16. Also the electric connections are integrated into the adaptor rail.

The two structural components 24 and 25 together form the plug-in unit 1, which is connected via guide rails 19 to the switch cabinet. All "fire extinguishing components" 3, 4, 5, 7, 8 as well as the nozzle tube 9 are integrated into the cuboid fire extinguishing agent container 2 or mounted thereto, so that they form together with the latter a compact structural unit.

In the front region of the plug-in unit 1, which is slidingly insertable in guide rails 19, there is arranged an operating and display panel 6.

The extinguishing agent container is designed in a flat configuration and with a substantially cuboid shape. A loading cartridge 3 and also the filling level monitoring device 7, the container closing device designed as a bursting disk 8, the overpressure device 5 and the device for controlling the flow of extinguishing agent 29, which can be activated by the release device 4, are integrated into the container. The device for controlling the flow of extinguishing agent 29 is located between the loading cartridge 3 and the extinguishing agent container 2.

Samples of air are drawn in via the intake pipe 16 by means of a fan 13 and guided to the sensors 15. The sensor electronics 14 and the sensor 15 are likewise located in the structural component 25. Furthermore, the emergency power unit 11, the evaluation electronics 10 and the power supply unit 12 are likewise arranged in this region.

FIG. 3 shows a top view of the extinguishing agent container 26 in a configuration with hollow sections, four tensile forces absorbing elements 27 being arranged centrally in a row and with an equal distance to all vertical walls in such a manner that they absorb tensile forces between the upper and lower walls. The sectional view A-A is shown in FIG. 4. In the extinguishing agent container 26, there are provided openings or connections, respectively, for the outlet of the extinguishing agent and the connection of the loading cartridge. These openings are, however, not shown in FIGS. 3 and 4.

FIG. 5 shows, analogously to FIG. 2, a plug-in unit 1, which is slidingly insertable into the switch cabinet, the left side of which shows the complex but nevertheless compact structural component 24 of the extinguishing agent container, whereas the right side shows the structural component "fire alarm system with electric control device" 25. The complex structural component 24 represents a compact element, which is shown in detail in FIG. 6. This structural component, which contains the "fire extinguishing components", may be mounted particularly quick and in a space-saving manner.

FIG. 6 shows the structural component extinguishing agent container, consisting of the extinguishing agent container 2 with the filling level monitoring device 7, the loading cartridge 3, the release device 4 and the device for controlling the flow of extinguishing agent 29, which, in this case, forms at the same time, the closing device of the container. Opposite to the opening in the extinguishing agent container 2, there is arranged the overpressure device 5. The extinguishing agent is moved via the device for controlling the flow of extinguishing agent 29 to the nozzle tube 22 or the nozzle, respectively.

FIG. 7 shows an embodiment, in which the fire extinguishing system is not a part of a built-in and plug-in unit of a switch cabinet, but is mounted at the wall of a switch cabinet, for example at the door. The unit for wall mounting 28 consists of the extinguishing agent container 2, which has in the present case assembly dimensions of 370 mm×280 mm×170 mm and is filled with 1,900 grams extinguishing agent of the type FK-5-1-12, for example, and in which all functional parts are integrated. In the extinguishing agent container 2 in a flat configuration there are integrated in the present case a connection for the directly screwed-on device for controlling the flow of extinguishing agent 29 with an integrated nozzle and a filling level indicator 7. Furthermore, a battery as emergency power unit 11, sensor electronics 14, evaluation electronics 10 and an operating and display panel 6 are integrated into the extinguishing agent container 2. The sensor electronics 14, the evaluation electronics 10 and the operating and display panel 6 are here combined on a carrier for structural components 30 forming part of the unit 28. For the detection of fire, the unit 28 is connected to a fire alarm, which is not shown. When a fire is detected by means of the separate automatic fire alarm, preferably an optical smoke detector, the changes of the threshold values thereof are evaluated by the electronics and the device for controlling the flow of extinguishing agent 29 is activated. A rotor integrated therein is preferably moved by an electric motor and rotated at high speed. By the rotation of the rotor, the extinguishing agent is spread into the interior space to be protected. In this case, an opening at the device represents the nozzle 22.

FIG. 8 shows the sectional view A-A of FIG. 7 with the rotor 31 and the electric motor 32 at the extinguishing agent container 2 and the outlet opening for the extinguishing agent 22.

In the following text, the function of the fire extinguishing system of the switch cabinet is described by way of example with reference to the embodiment shown in FIG. 2:

By means of the fan 13, samples of air are permanently taken from the cabinet via the intake pipe 16 and guided over the sensors 15. The sensors 15 are permanently monitored by the sensor electronics 14 and, in the case that a preset alarm threshold is succeeded, this condition is passed on to the evaluation unit 10. In this regard, discrimination between pre-alarm and fire alarm as well as a dependency on one or two detectors may be adjusted. Besides a self-acting automatic activation there is also the possibility to give the alarm manually by means of one or more external manually releasable alarm annunciators that are connected via an interface. In both cases, the evaluation electronics 10 control the operation programmed for this case, show the alarm condition at the display panel 6, release the programmed transmission to higher-order systems, control the optional acoustic and optical alarm devices and activates the release device 4 electrically after a predetermined period of time. This electric pulse is transferred into a mechanical pulse by means of the device for controlling the flow of extinguishing agent 29, resulting in an opening of the loading cartridge 3 and a flow of propellant agent into the extinguishing agent container 2. By the increase of pressure in the extinguishing agent container 2, the container-closing device 8 is opened and releases the flow of extinguishing agent to the nozzle tube 9, in which it is sprayed through openings of the nozzle 22 and distributed in the cabinet. The container-closing device 8 seals the extinguishing agent container 2 over the nozzle tube 9 or the nozzle 22, respectively. This avoids in the case of extinguishing agents stored in liquid form that they volatilize due to their inherent vapor pressure and thus will no longer be available as extinguishing agent stock. By means of the container-closing device 8 it is also prevented that extinguishing agent leaks from the container 2 during transportation and is affected by reactions with ambient air, e.g. by forming clots due to absorption of humidity in the case of extinguishing powder. The extinguishing agent container 2 is protected against overpressure by means of the overpressure device 5. The filling level device 7 notifies the evaluation unit 10 of a loss of extinguishing agent, which generates a trouble indication (loss of extinguishing agent) at the display panel 6 and provides a potential-free signal at the adaptor rail 17 for a transmission to higher-order systems. The power supply of the cabinet extinguishing system is ensured by two sources, in particular by a power supply unit 12 on the one hand, which also provides for the loading of the emergency power unit 11, and by the emergency power unit (accumulator) on the other hand. For a simultaneous monitoring and activation of several fire extinguishing systems, interfaces are available, which send information about the activation of an extinguishing process or status reports to the first fire extinguishing system, so that an indication is provided there. By means of the adaptor rail 17, the plug-in unit 1 may be exchanged very quickly. The main connections, like power supply, signal interchange and intake pipe 16 are fixedly connected to the cabinet 18 and coupled with the "plug-in unit" by means of the adaptor rail 17.

The fire extinguishing system for casings has the advantage that all "fire extinguishing components" are contained in or provided at the extinguishing agent container, which represents a complex but compact structural component and may be inserted with low space requirement in a quick and reliable manner into e.g. a switch cabinet, samples of air being able to be taken at the locations provided therefor and the extinguishing agent being discharged at the predetermined locations in the casing of the switch cabinet.

List Of Reference Numbers Used

1 build-in and plug-in unit
2 extinguishing agent container in a flat configuration
3 loading cartridge
4 release device for external activation
5 overpressure device
6 operating and display panel
7 filling level monitoring device
8 container-closing device
9 nozzle tube
10 evaluation electronics
11 emergency power unit
12 power supply unit
13 fan
14 sensor electronics
15 sensors
16 intake pipe
17 adaptor rail
18 switch cabinet
19 guide rail
20 compartment of the switch cabinet
21 openings in intake pipe 16
22 nozzle
23 fire extinguishing system
24 structural component "extinguishing agent container"
25 structural component "fire alarm system with electric control device"
26 extinguishing agent container made as hollow section
27 tensile forces absorbing element
28 unit for wall-mounting
29 device for controlling the flow of extinguishing agent
30 carrier for structural components, part of 28
31 rotor
32 electric motor

The invention claimed is:

1. A fire extinguishing system for an electronics casing, comprising, a cuboid extinguishing agent container in combination with an overpressure device, a filling level monitoring device, a container closing device, a device for controlling the flow of extinguishing agent, a rotor, and an electric motor, said combination required for storing and monitoring the loss of extinguishing agent, said combination for controlling the flow of extinguishing agent from the container and for connecting a discharge device for the extinguishing agent, the overpressure device, filling level monitoring device, container-closing device, device for controlling the flow of extinguishing agent, rotor, and electric motor being fastened at or being integrated in the extinguishing agent container in such a manner that the extinguishing agent container may be transported, installed, or arranged as a compact structural component.

2. A fire extinguishing system as claimed in claim 1, wherein there are fire alarm devices and there are electronic activation devices which are arranged at or in the extinguishing agent container.

3. A fire extinguishing system as claimed in claim 1, wherein there is a loading cartridge and a release device for controlling the flow of extinguishing agent from the container and for controlling a pressure build-up in the extinguishing agent container which are arranged at or in the extinguishing agent container.

4. A fire extinguishing system as claimed in claim 1, wherein the release device us affected mechanically by a ball valve or electrically by a magnetic valve or pyrotechnically or electromechanically, or by puncturing a membrane which seals the container, or by releasing a gas from a gas generator or by means of an electromechanical actuator.

5. A fire extinguishing system as claimed in claim 1, wherein the device for controlling the flow of extinguishing agent and the container-closing device are combined to a structural unit.

6. A fire extinguishing system as claimed in claim 1, wherein the overpressure device is a bursting disk, a safety valve, or a defined break-off piece arranged in the extinguishing agent container.

7. A fire extinguishing system as claimed in claim 1, wherein for the monitoring of losses, a mechanical pressure transducer, a manometer, a gauge-glass, or an electric monitoring device with an inductive, capacitive, optical, or mechanical sensor or a weighing device is provided.

8. A fire extinguishing system as claimed in claim 1, wherein a loading cartridge, said device for controlling the flow of extinguishing agent, the container-closing device and a connection for a nozzle and/or a nozzle tube are arranged at or in the extinguishing agent container.

9. A fire extinguishing system as claimed in claim 1, wherein an evaluation electronics, an emergency power unit, and a power supply unit are required for producing a fire alarm and for electronic control, and are arranged as a complex structural component at or in the extinguishing agent container.

10. A fire extinguishing system as claimed in claim 1, wherein the structural component is designed in a flat configuration with a maximum height of 44.5 mm.

11. A fire extinguishing system as claimed in claim 1, wherein a device for electronic control of an evaluation electronics, an emergency power unit, a power supply unit, a fan, a sensor, a sensor electronics, and an intake pipe are arranged as a complex structural component at or in the extinguishing agent container.

12. A fire extinguishing system as claimed in claim 1, wherein the device for controlling the flow of extinguishing agent represents a mechanical conveying device with a release device, which closes the container.

13. A fire extinguishing system as claimed in claim 1, wherein said electric motor with said rotor is provided at the extinguishing agent container as a mechanical conveying device for controlling the flow of extinguishing agent.

14. A fire extinguishing system for a casing, preferably an electronics casing, consisting of:

a cuboid extinguishing agent container, in which the extinguishing agent is stored, and a control device for the flow of extinguishing agent, wherein the cuboid extinguishing agent container together with a device required for storing and monitoring the loss of extinguishing agent, a device for controlling the flow of extinguishing agent from the container and a device for connecting a discharge device for the extinguishing agent, the devices being fastened at or being integrated in the extinguishing agent container in such a manner that it may be transported, installed or arranged in the casing as a compact structural component.

15. A fire extinguishing system for an electronics casing comprising a cuboid extinguishing agent container in combination with an overpressure device, a filling level monitoring device, a container-closing device, a device for controlling the flow of extinguishing agent, said combination required for storing and monitoring the loss of extinguishing agent, said combination for controlling the flow of extinguishing agent from the container and for connecting a discharge device for the extinguishing agent, the overpressure device, filling level monitoring device, container-closing device, device for controlling the flow of extinguishing agent being fastened at or being integrated in the extinguishing agent container, in such a manner that the extinguishing agent container may be transported, installed or arranged as a compact structural component.

* * * * *